United States Patent [19]

Wallman

[11] 4,448,666

[45] May 15, 1984

[54] RETORTING PROCESS FOR HYDROCARBONACEOUS SOLIDS

[75] Inventor: P. Henrik Wallman, Berkeley, Calif.

[73] Assignee: Chevron Research Company, San Francisco, Calif.

[21] Appl. No.: 423,336

[22] Filed: Sep. 24, 1982

[51] Int. Cl.³ ..... C10G 1/02; C10B 53/06; C10B 49/16

[52] U.S. Cl. ..... 208/11 R; 208/8 R; 201/31

[58] Field of Search ..... 208/8 R, 11 R; 201/31

[56] References Cited

U.S. PATENT DOCUMENTS

| | | | |
|---|---|---|---|
| 2,582,712 | 1/1952 | Howard | 208/11 R |
| 3,167,494 | 1/1965 | Crawford | 208/11 R |
| 3,318,798 | 5/1967 | Kondis et al. | 208/11 R |
| 3,501,394 | 3/1970 | Lyons | 208/11 R |
| 4,064,018 | 12/1977 | Choi | 208/11 R X |
| 4,087,347 | 5/1978 | Langlois et al. | 208/11 R |
| 4,110,193 | 8/1978 | Gwyn et al. | 208/8 R |
| 4,133,739 | 1/1979 | Mitchell et al. | 208/11 R |
| 4,226,699 | 10/1980 | Nutter | 208/11 R |
| 4,227,990 | 10/1980 | Dearth et al. | 208/11 R X |
| 4,230,557 | 10/1980 | Bertelsen et al. | 208/11 R X |
| 4,293,401 | 12/1974 | Squires | 201/31 |
| 4,377,466 | 3/1983 | Wallman | 208/11 R |

*Primary Examiner*—Delbert E. Gantz
*Assistant Examiner*—Glenn A. Caldarola
*Attorney, Agent, or Firm*—S. R. LaPaglia; J. W. Ambrosius

[57] ABSTRACT

A process and apparatus for retorting a hydrocarbonaceous solids using a fluidized bed of heat-transfer material above a packed bed.

7 Claims, 2 Drawing Figures

RETORTING PROCESS FOR HYDROCARBONACEOUS SOLIDS

BACKGROUND OF THE INVENTION

Certain naturally occurring materials contain a hydrocarbonaceous component which upon heating will release a hydrocarbon product which is useful as a feedstock in petroleum processing. These "hydrocarbonaceous solids" such as oil shale, tar sands, coal and diatomaceous earth, may be pyrolyzed in reactor vessels having various designs. Prior to pyrolysis the solid feed usually must be reduced to a particulate material having a certain maximum particle size dependent on the type of retorting process. Unfortunately, with oil shale, which is a fissile rock, and to a lesser extent with the other materials, crushing and grinding usually yield a variety of particle sizes ranging from a fine dust to large chunks. The inability of conventional grinding and crushing operations to produce a feed of uniform particle size leads to downstream processing problems when a fluidized bed is used to pyrolyze the oil shale because such processes are able to tolerate only a limited range of particle sizes. In those processes using a recycled heat-transfer material, the solids handling problem is compounded by the increased volume of material.

The use of a partially fluidized bed to control the passage of solids through the pyrolysis zone is one means for extending the ability of the retort to handle a wide range of particle sizes. An example of this type of bed is the staged turbulent bed described in U.S. Pat. No. 4,199,432. However, such improvements still require that the amount and maximum size of non-fluidizable particles be controlled within specified limits. Since the crushing and grinding step in most oil shale processes significantly increases in cost as the maximum particle size and/or the amount of the largest particles are decreased, it is desirable to design any process to be able to handle as large a particle size as possible.

The present invention is concerned with a modified oil shale retorting process which increases the maximum particle size which can be tolerated in a retorting system using a fluidized particulate heat-transfer material.

SUMMARY OF THE INVENTION

The present invention is concerned with a process for pyrolyzing a particulate hydrocarbonaceous solid containing at least 50 weight percent non-fluidizable particles which comprises:

(a) passing the hydrocarbonaceous solid through a fluidized bed of hot, solid, heat-transfer particles of fluidizable size, whereby the hydrocarbonaceous solid is raised to a pyrolyzing temperature;

(b) retaining the heated hydrocarbonaceous solid in a vertical moving packed bed for a time sufficient to allow for the release of a substantial amount of product vapors from the pyrolyzed hydrocarbonaceous material;

(c) recovering separately from step (b) the product vapors and the pyrolyzed solid remaining from the hydrocarbonaceous solid;

(d) drawing the fluidized heat-transfer particles from off the top of the fluidized bed;

(e) heating the heat-transfer particles in a heating zone; and (f) introducing the hot heat-transfer particles of step (e) back into the fluidized bed of step (a).

The present invention is further directed to a vessel for pyrolyzing a hydrocarbonaceous solid comprising:

(a) a closed vertical elongate vessel divided into an upper zone and a lower zone, the top of said lower zone having open communication with the bottom of said upper zone, whereby solids passing out of the bottom of the upper zone enter the top of the lower zone;

(b) means for fluidizing a bed of particles of preselected size in the upper zone;

(c) a first inlet in the upper zone for introducing particles of fluidizable size;

(d) a second iinlet in the upper zone for introducing solids containing particles of non-fluidizable size into the top of the fluidized bed;

(e) a first outlet in the upper zone near the top of the fluidized bed for withdrawing particles therefrom;

(f) a second outlet in the bottom of the lower zone for withdrawing solids therefrom; and (g) means for recovering gases from both the upper and lower zones.

The superficial gas velocity at which a given particle size becomes fluidized in a bed of similar particles is termed the minimum fluidization velocity. As used herein, fluidizable particles are distinguished from both non-fluidizable particles and entrained particles. "Non-fluidizable particles" refer to particles of too large a size to fluidize at prevailing bed conditions. Non-fluidized particles thus sink to the bottom of the fluidized bed and form the vertical moving packed bed in the lower zone. Sometimes the fluidizable particles are referred to as flotsam and the non-fluidized particles are referred to as jetsam. Entrained particles are particles which are transported by the gas stream principally in an upward direction as opposed to the random motion characterizing fluidization.

The heat-transfer material employed with the present invention is a particulate solid in which the majority of the particles present will be of fluidizable size. Generally, at least about 70 weight percent of the heat-transfer particles should fall within the fluidizable size range. More preferably at least 90 weight percent of the heat-transfer particles will be fluidizable. Particularly undesirable are very fine size heat-transfer particles of entrainable size which may contaminate the product vapors and become trapped in the condensed product oil. Large non-fluidizable particles of heat-transfer material are not retained in the fluidized bed and become mixed with the hydrocarbonaceous solid. This increases the volume of material that must be handled in the packed bed but otherwise poses no problem for the process. Within limits the presence of some heat-transfer material in the packed bed may be desirable to maintain the hydrocarbonaceous solid at a pyrolyzing temperature. However, some heat-transfer material of fluidizable size will usually also be carried down with the hydrocarbonaceous solid into the packed bed.

The heat-transfer material preferably is the recycled residue that remains after the carbonaceous components of the raw feed have been removed by pyrolysis and/or combustion. Alternately, the heat-transfer solid may be some other readily available particulate solid such as for example rock, ceramic compositions, sand, alumina, steel or the like.

DETAILED DESCRIPTION OF THE INVENTION

Figure 1:
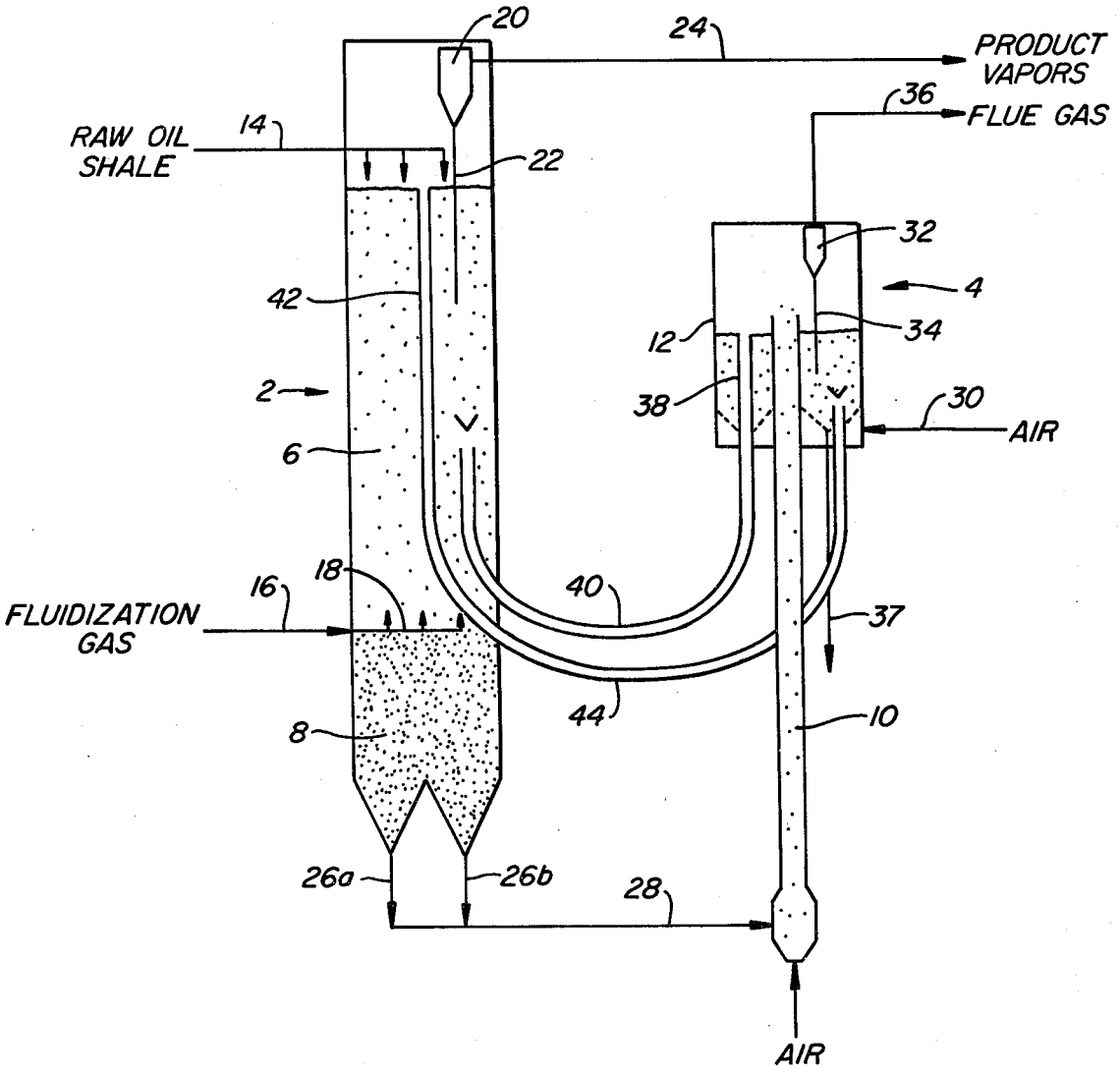
FIG. 1 shows a vessel for retorting oil shale which may be used in practicing the invention, accompanied by a combustor.

The invention may be understood more clearly by referring to FIG. 1. Shown is a process scheme for recovering shale oil from oil shale by heating the raw oil shale to a temperature sufficient to pyrolize the hydrocarbonaceous component, referred to as kerogen, to release shale oil vapors. The pyrolyzed oil shale retains a carbonaceous residue which is burned to provide heat for the process. The inorganic material recovered from the combustion of the pyrolyzed oil shale is recycled as heat-transfer material. One skilled in the art will recognize that the process scheme which will be described with only minor modification could also be used to pyrolyze other hydrocarbonaceous materials.

Shown in FIG. 1 is a retorting vessel 2 and a combustor 4. The retorting vessel 2 is divided into an upper zone 6 containing a fluidized bed of particles and a lower zone 8 containing a packed bed. The combustor 4 is divided into a lift pipe 10 and a secondary combustion and separation chamber 12. In an alternate embodiment, several liftpipes may be employed with the secondary combustor.

In operation oil shale which has been crushed and ground to a maximum particle size of about ½ inch is introduced by raw shale inlet 14 into the top of the fluidized bed contained in the upper zone 6 of the retorting vessel 2. The fluidized bed is composed of a mixture of hot heat-transfer material from the combustor and oil shale particles of fluidizable size. The majority of the raw oil shale is composed of particles too large to be fluidized and will drop through the fluidized bed into the lower zone. Even so, the residence time of the non-fluidizable oil shale particles in the fluidized bed is sufficient to raise the particles to a temperature sufficient to pyrolyze the kerogen, preferably about 900° F. The fluidization gas is composed of hydrocarbon vapors from the decomposition of the kerogen and optionally of a supplemental fluidization gas such as steam introduced into the bottom of the upper zone by fluid gas inlet 16 and gas distribution ring 18. If properly designed the evolution of hydrocarbon vapors in lower zone 8 will be sufficient to maintain the fluidization in the upper zone with a minimum of supplemental fluidization gas being required. In such a case the supplemental fluidization gas is used principally during start-up.

The non-fluidized particles along with some particles of fluidizable size drop through the gas distribution ring 18 into the vertical moving packed bed contained in lower zone 8 of the retorting vessel 2. The heated raw oil shale particles are retained in the packed bed for a time sufficient to complete the pyrolysis of the kerogen in the oil shale, usually about 5 to 20 minutes, the exact residence time being dependent on the pyrolysis temperature. As already noted, the evolved hydrocarbon vapors pass upward, mix with the supplemental fluidization gas entering at the bottom of the upper zone, and serve as fluidization gas for the fluidized bed. The product vapors, supplemental fluidization gas, and entrained fines enter cyclone 20 where the majority of the fines are removed and returned to the fluidized bed by dipleg 22. The gas exits the retort by means of gas outlet 24 and is sent to a product recovery zone (not shown) where the condensible shale oil vapors are separated from the non-condensible gas. If desired, a stripping gas such as steam also may be injected into the bottom of the lower zone to aid in carrying away the product vapors.

The pyrolyzed oil shale containing residual carbonaceous residue is withdrawn from the bottom of the lower zone by drawpipes 26*a* and 26*b* and pass by L-valve 28 to the bottom of liftpipe 10 of the combustor 4. The shale particles are entrained in a stream of air and carried up the length of the liftpipe. During passage along the liftpipe the carbonaceous residue is ignited and partially burned. The hot, partially burned particles exit the top of the liftpipe and enter the secondary combustion and separation chamber 12 of the combustor. Secondary air entering the bottom of the chamber 12 via secondary air conduit 30 serves as a fluidization gas for the fluidized bed in the bottom of the chamber and as a source of oxygen for the combustion of any unburned carbon residue in the solids. Flue gases and entrained flues pass through rough cut cyclone 32 which recovers particles larger than a pre-selected size and returns them via dipleg 34 to the fluidized bed. The flue gas and fines leave the combustor by means of flue gas outlet 36. Non-fluidizable particles settle to the bottom of the bed and are withdrawn by coarse solids drawpipe 37 for disposal. The amount of non-fluidized particles is generally small because of the attrition of particles that occurs in the combustor. Thus particles of entrainable size and non-fluidized particles are removed from the secondary combustion and separation chamber 12 while particles of fluidizable size are selectively retained for use as heat-transfer solids.

The hot, heat-transfer solids, i.e., burned fluidizable shale particles, are withdrawn from the top of the fluidized bed in the secondary combustion and separation chamber by overflow well 38 and recycled to the fluidized bed in the upper zone 6 of the retorting vessel 2 by recycle conduit 40. Fluidized particles in the upper zone 6 of the retort are returned directly to the secondary combustion and separation zone via overflow well 42 and recycle conduit 44. Thus the heat-transfer material is continually circulated between the upper zone 6 and the secondary combustion and separation zone 12. Aeration with an inert gas such as steam may be used in recycle conduits 40 and 44 to ensure that no interchange of gas takes place between the retort and combustor and to maintain a fluidized state in these conduits.

Figure 2:
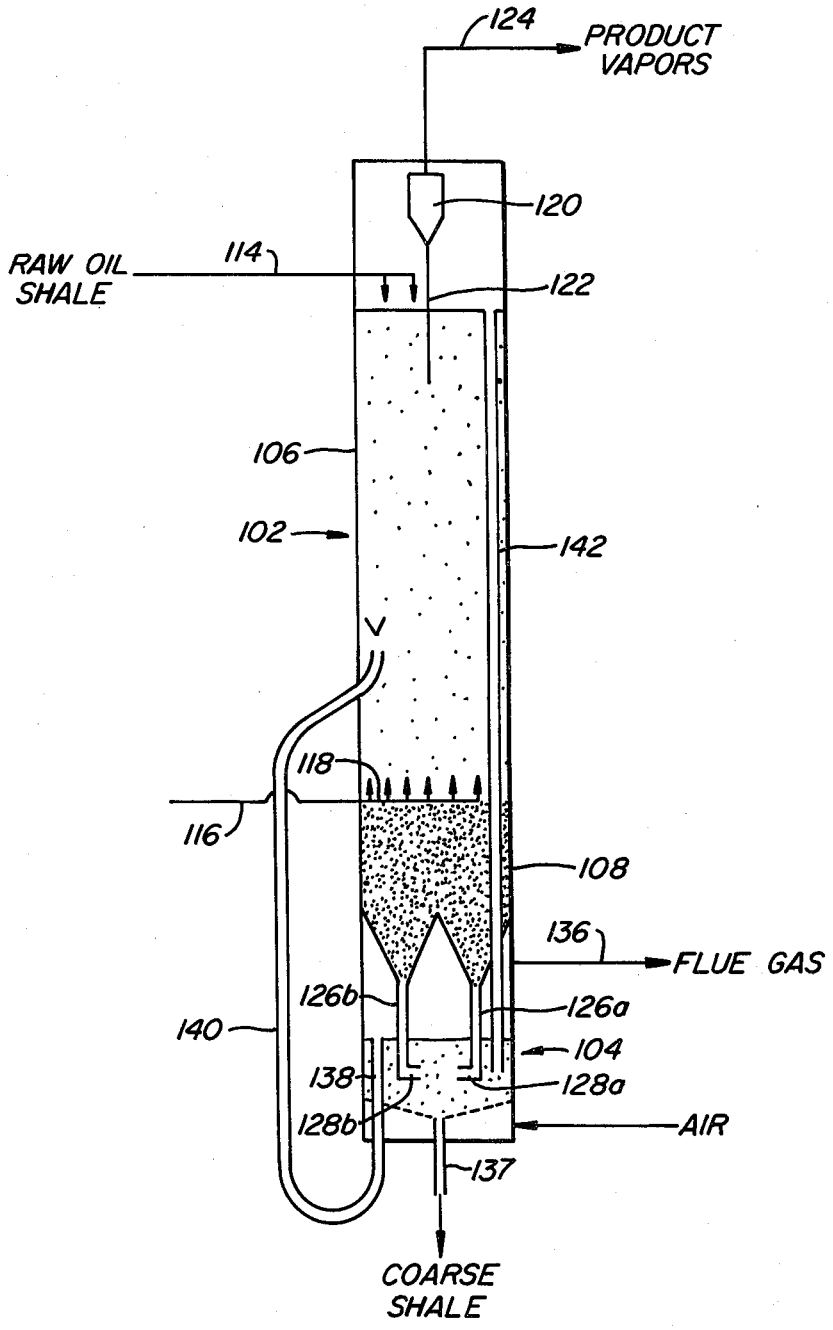
FIG. 2 illustrates an alternative embodiment of the retort/combustor combination for retorting oil shale.

FIG. 2 shows an alternate embodiment of the invention in which the retorting vessel 102 is located directly above the combustor 104. The principle of operation is the same as described above, and the differences relate to the arrangement of the retort and combustor.

In this embodiment raw oil shale enters the top of the upper zone 106 of the retort via raw shale inlet 114. The raw shale drops through the bed of the heat-transfer particles fluidized by evolving product vapors in the packed bed of the lower zone 108 and by supplemental fluidization gas entering the bottom of the upper zone by means of fluidization gas inlet 116 and gas distribution ring 118. As the raw oil shale passes through the fluidized bed of the upper zone, it is heated to a temperature sufficient to pyrolyze the kerogen. In the packed bed of the lower zone 108, the hot oil shale is retained for a sufficient time to complete the decomposition of the kerogen to form product vapors. The product vapors mixed with fluidization gas pass into cyclone 120 at the top of the upper zone. Particulates removed by the cyclone are returned to the fluidized bed by dipleg 122. Retort gas is recovered by gas outlet 124.

The pyrolyzed solids are withdrawn from the bottom of the lower zone by drawpipes 126a and 126b which feed through L-valves 128a and 28b directly into a fluidized bed contained in the combustor 104. Unlike the embodiment shown in FIG. 1, in the present embodiment all of the combustion of the carbonaceous residue takes place in the fluidized bed. Fluidization gas and oxygen for the combustor is supplied by air entering the bottom of the bed. Flue gases and entrained fines are removed via flue gas outlet 136. Although not shown, a rough cut cyclone may be used to recover particles of fluidizable size from the flue gas and return them to the combustor. Coarse non-fluidizable material is withdrawn by means of coarse solids drawpipe 137. Hot, heat-transfer material is recycled to the upper zone 106 of the retort by overflow well 138 and recycle conduit 140. Fluidized particles in the upper zone are drawn from the top of the fluidized bed of the zone by means of overflow well 142 which empties directly into the fluidized bed of the combustor. Aeration with an inert gas such as steam is used in recycle conduits 140 and 142 to ensure that no interchange of gas takes place between the retort and combustor and to maintain a fluidized state in these conduits.

As described above, the process of the invention recycles the pyrolyzed and burned oil shale as heat-transfer material. However, the process may also employ other materials as heat-transfer particles. As already noted, materials suitable for use as heat-transfer material include particulate rocks, ceramic compositions, sand, alumina, steel, etc. In some retorting processes these materials are used exclusively as the heat-transfer particles. Most preferably these materials serve as supplemental heat-transfer material, i.e., they merely supplement the recycle shale.

Decomposition of the kerogen in the oil shale occurs at temperatures in excess of about 400° F. For practical retorting processes the pyrolyzing temperatures are usually much higher, generally falling within the range of from about 850° F. to about 1000° F. At temperatures above about 1000° F., undesirable thermal cracking of the shale oil vapor takes place resulting in a significant oil yield loss due to production of light hydrocarbon gases and associated coke formation. The temperature to which the recycle material is heated prior to introduction into the retort depends upon a number of factors such as the ratio of heat carrier to raw oil shale, the grade of raw oil shale, the coke yield in the retort and the efficiency of the combustion. Generally, the temperature of heat carrier particles is in the range of from about 1100° F. to about 1600° F. at the time it enters the retorting vessel. In carrying out the present invention a recycle ratio in the range of about 1 to about 5 (recycle/raw shale) is usually employed with a ratio in the range of from about 2 to 3 being preferred.

It is desirable that the majority of the heat-transfer particles fall within the fluidizable size range. In the process described above the selection of fluidization particles in the combustor for recycling to the retort is inherent in the design. The exact cut size of the particles will vary with the details of the process. Thus, an optimal size range for recycle material cannot be stated generally, but is dependent on the fluidization conditions prevailing in the retort which in turn is dependent on the raw shale grade and the raw shale throughput. In determining the optimal size range of the particles such factors must be considered as the superficial velocity of the fluidization gas, the density of the heat-transfer material, and the increase in gas velocity due to product vapor evolution. In a process such as described above, assuming an average superficial gas velocity in the fluidized portion of the retort of about 2 feet per second, a good cut size for the recycle material would be between 16 and 200 mesh (Tyler Standard Sieve).

Any supplemental fluidization gas and/or purge gas introduced into the retort should be an inert gas, i.e., a non-oxidizing gas, to minimize the loss of yield due to oxidation of the product vapors. Suitable gases for use in the retort include steam, recycled retort gas, natural gas, etc. It has been calculated that the product vapors generated by the pyrolysis of the kerogen in 19 gallons per ton oil shale, i.e., one ton of raw oil shale yield 19 gallons of shale oil, in a retorting vessel having a throughput 4000 lbs/hr/ft$^2$ of fresh shale will yield a superficial gas velocity at the top of the fluidized bed of about 1.5 feet per second. This is within the range of acceptable gas velocity for fluidizing expected heat-transfer particles.

The fluidized bed in the upper zone of the retort must be sufficiently deep to allow adequate residence time for the non-fluidized oil shale particles to achieve a pyrolyzing temperature. It is desirable that the raw shale achieve at least about 85 percent of the average temperature of the fluidized bed before entering the lower zone, more preferably the raw shale should achieve at least 95 percent of the average bed temperature. It has been calculated that a fluidized bed 70 feet deep would be suitable for achieving 95 percent of bed temperature for raw shale particles having a maximum size of ½ inch.

What is claimed is:

1. A process for pyrolyzing a particulate hydrocarbonaceous solid containing a fraction of non-fluidizable particles making up at least 50 weight percent of the total particulate hydrocarbonaceous solids which comprises:

(a) passing the hydrocarbonaceous solid downwardly through a bed of hot, solid, heat-transfer particles of fluidizable size, said bed of heat-transfer particles being fluidized by an inert gas passing upward through said bed at a superficial gas velocity sufficient to fluidize the heat-transfer particles but insufficient to fluidize the non-fluidizable fraction of the hydrocarbonaceous solids, whereby the hydrocarbonaceous solid is raised to a pyrolyzing temperature;

(b) retaining the heated non-fluidizable fraction of the hydrocarbonaceous solids in a vertical moving packed bed located below the fluidized bed of heat-transfer solids for a time sufficient to allow for the release of a substantial amount of product vapors from the pyrolyzed hydrocarbonaceous material;

(c) recovering from step (b) the product vapor and the pyrolyzed solid remaining from the non-fluidizable fraction of the hydrocarbonaceous solids, said product vapors being recovered from the top of the packed bed and are introduced into the bottom of the fluidized bed of heat-transfer solids to serve as inert fluidizing gas;

(d) drawing the fluidized, heat-transfer particles from off the top of the fluidized bed;

(e) heating the heat-transfer particles in a heating zone; and (f) introducing the hot, heat-transfer particles of step (e) back into the fluidized bed of step (a).

2. The process of claim 1 wherein at least part of the heat-transfer material is the recycled residue from the pyrolyzed hydrocarbonaceous solid.

3. The process of claim 1 wherein the carbonaceous residue remaining in the pyrolyzed hydrocarbonaceous solid is burned to heat the heat-transfer material in step (e).

4. The process of claim 1 wherein the hydrocarbonaceous solid achieves at least 85 percent of the average temperature of the fluidized bed in step (a).

5. The process of claim 1 wherein an inert supplemental fluidization gas is mixed with the product vapors.

6. The process of claim 5 wherein the supplemental fluidization gas is selected from steam, natural gas, recycled retort gas, or a combination thereof.

7. The process of claim 1 wherein the hydrocarbonaceous solid is oil shale.

* * * * *